US009841026B2

(12) United States Patent
Stinessen et al.

(10) Patent No.: US 9,841,026 B2
(45) Date of Patent: Dec. 12, 2017

(54) SUBSEA PRESSURE BOOSTER

(75) Inventors: Kjell Olav Stinessen, Oslo (NO); Asbjørn Eriksen, Skallestad (NO)

(73) Assignee: Aker Solutions AS, Lysaker (NO)

( * ) Notice: Subject to any disclaimer, the term of this patent is extended or adjusted under 35 U.S.C. 154(b) by 873 days.

(21) Appl. No.: 14/004,029

(22) PCT Filed: Mar. 15, 2012

(86) PCT No.: PCT/NO2012/000028

§ 371 (c)(1),
(2), (4) Date: Dec. 10, 2013

(87) PCT Pub. No.: WO2012/125041

PCT Pub. Date: Sep. 20, 2012

(65) Prior Publication Data

US 2014/0086764 A1 Mar. 27, 2014

(30) Foreign Application Priority Data

Mar. 15, 2011 (NO) ..... 20110398

(51) Int. Cl.
*F04D 13/08* (2006.01)
*F04D 13/02* (2006.01)
(Continued)

(52) U.S. Cl.
CPC ..... *F04D 13/026* (2013.01); *F04D 1/06* (2013.01); *F04D 13/024* (2013.01);
(Continued)

(58) Field of Classification Search
CPC .... F04D 25/0686; F04D 29/058; F04D 13/08; F04D 13/024; F04D 25/026;
(Continued)

(56) References Cited

U.S. PATENT DOCUMENTS 5,382,141 A * 1/1995 Stinessen ..... E21B 43/01 166/105.5
5,641,275 A * 6/1997 Klein ..... F04D 29/0413 415/176

(Continued)

FOREIGN PATENT DOCUMENTS

CN 101705944 A 5/2010
CN 101818736 A 9/2010

(Continued)

OTHER PUBLICATIONS

Hodneland, John André W., "International Search Report" for PCT/NO2012/000028, dated Jun. 8, 2012, 3 pages.

*Primary Examiner* — Nathan Zollinger
(74) *Attorney, Agent, or Firm* — Winstead PC

(57) ABSTRACT

Subsea turbomachine for boosting the pressure of petroleum fluid flow from subsea petroleum productions wells or systems, comprising an electric motor and a compressor or pump driven by the electric motor, a fluid inlet and a fluid outlet, distinctive that the turbomachine comprises a pressure housing common for the electric motor or stator, and compressor, pump or rotor; a magnetic gear inside the common pressure housing for operative connection between the motor or stator and compressor, pump or rotor; and a partition inside the common pressure housing, arranged so as to separate a motor or stator compartment from a compressor, pump or rotor compartment.

10 Claims, 9 Drawing Sheets

(51) Int. Cl.

| | |
|---|---|
| ***F04D 1/06*** | (2006.01) |
| ***F04D 17/12*** | (2006.01) |
| ***F04D 25/02*** | (2006.01) |
| ***F04D 25/06*** | (2006.01) |
| ***F04D 13/06*** | (2006.01) |

(52) U.S. Cl.
CPC ..... *F04D 13/0653* (2013.01); *F04D 13/08* (2013.01); *F04D 13/086* (2013.01); *F04D 17/122* (2013.01); *F04D 25/026* (2013.01); *F04D 25/0686* (2013.01)

(58) Field of Classification Search
CPC .. F04D 13/026; F04D 13/086; F04D 13/0653; F04D 1/06; F04D 17/122
USPC ..... 417/420, 410.1
See application file for complete search history.

(56) References Cited

U.S. PATENT DOCUMENTS

| | | | | |
|---|---|---|---|---|
| 5,856,719 | A * | 1/1999 | De Armas | H02K 49/06 310/103 |
| 7,225,876 | B2 * | 6/2007 | Laureano | H01R 13/523 166/343 |
| 7,549,467 | B2 * | 6/2009 | McDonald | H02K 49/102 166/105 |
| 7,654,328 | B2 * | 2/2010 | Stinessen | F04D 25/0606 166/337 |
| 1,042,965 | A1 | 2/2011 | Atallah et al. | |
| 8,523,540 | B2 * | 9/2013 | Eide | 310/52 |
| 2006/0157251 | A1 | 7/2006 | Stinessen et al. | |
| 2009/0266553 | A1 * | 10/2009 | Skofteland | F04D 17/122 166/351 |
| 2010/0032952 | A1 | 2/2010 | Hatch et al. | |
| 2010/0129237 | A1 * | 5/2010 | Eide | F04D 29/586 417/410.1 |
| 2011/0057456 | A1 * | 3/2011 | Atallah | H02K 49/102 290/1 C |
| 2011/0127864 | A1 * | 6/2011 | Nybo | F04D 13/027 310/87 |

FOREIGN PATENT DOCUMENTS

| | | | |
|---|---|---|---|
| CN | 101922456 | | 12/2010 |
| DE | 102008014379 | A1 | 9/2009 |
| GB | 2457226 | A | 8/2009 |
| RU | 2140574 | C1 | 10/1999 |
| RU | 2329405 | C2 | 7/2008 |
| SU | 81471 | A1 | 11/1949 |
| WO | WO-2006133703 | A1 | 12/2006 |

* cited by examiner

SUBSEA PRESSURE BOOSTER

FIELD OF THE INVENTION

The present invention relates to pressure boosting. More specifically, the invention relates to compressors and pumps, particularly subsea compressors and pumps, including multiphase pumps, for boosting the pressure of gas, multiphase or liquid from subsea petroleum production wells or systems. In the follow will be used a common term: Pressure boosters; for turbo machines such as compressors, multiphase pumps and liquid pumps.

BACKGROUND OF THE INVENTION AND PRIOR ART

The pressure of a petroleum reservoir, particularly a gas reservoir, decline rather rapidly during production. In order to maintain and prolong production from subsea reservoirs, often involving long transport through a pipeline of the produced fluid, pressure boosting is required.

In FIG. 1 is illustrated the process of a subsea compression station. The rotating equipment is compressors and pumps. The rotational speed of pumps is typically in the range of 3000-4000 rpm while compressors operate typically in the range of 5000-12000 rpm.

Reference is made to Table 1 for understanding of this figure. To give an idea of dimensions, the diameter of the separator in FIG. 1 can be in range of 3 m and height 10 m.

TABLE 1

| Item # | Explanation |
|---|---|
| a | Separator |
| b | Compressor |
| b' | Compressor motor |
| c | Pump |
| c' | Pump motor |
| d | Lower liquid level |
| e | High liquid level |
| f | High-high liquid level |
| g | Polishing equipment, e.g. cyclones |
| g' | Lower edge of cyclones |
| h | Downcomer |
| i | Outlet from downcomer |
| j | Antisurge valve with actuator |
| k | Antisurge cooler |
| l | Cable for supply of electric power to compressor motor |
| m | Cable for supply of electric power to pump motor |
| n | Liquid recirculation pipe |
| o | Gas recirculation pipe |
| p, p', p'', p''' | Valves |
| q | Electric connector for compressor motor |
| q' | Electric connector for compressor motor |
| r | Liquid recirculation valve |

A typical power requirement for pressure boosting of such a compressor train is 5-15 MW. This, combined with high transmission frequency, limits the length of an electric subsea step out cable, laid out from and controlled from surface (topside or onshore) via a surface variable speed drive (VSD). More specifically, the Ferranti effect, and possibly also other effects, limits the subsea length of high power high frequency electric step out cables to about 40-50 km.

The state of the art of subsea compressors (motor-compressors) are indicated in FIG. 2 where the main components are the compressor which is driven by an electric high speed motor that rotates at the speed that the compressor needs, i.e. the motor rotates at a speed typically in the range of 5000 to 12000 rpm. The motor speed is transmitted to the compressor by at least one shaft that connects motor and compressor. The frequency of the electric power to give this speed for the motor and thereby the compressor must be in the range of approximately 80 to 200 Hz for a 2-pole motor. The shaft power of the compressor motor can typically be in the range of 5-15 MW and possibly larger in the future. Stable transmission of electric power at the high frequencies that the motor requires is feasible if the distance from the power supply, normally from onshore or topsides (surface) is limited to the range of 40-50 km. If the step out distance is more than this, the power transmission through the cable becomes instable and inoperable. In such cases there will be contradictory requirements between the high frequency that the motor needs to give the right speed and the low frequency, say typically 40-70 Hz, which is necessary to have a stable power transmission. This contradiction can be resolved by low frequency power transmission and local increase of frequency by placing a subsea variable speed drive (SVSD) close to the motor.

The atmosphere of the motor-compressor in FIG. 1 will be gas, either the gas being boosted or an inert gas supplied from a reservoir. The term inert gas in the context of this patent description means any gas that is not harmful to the internal materials of the motor, and also of the gear in cases where such a gear is located in the same compartment as the motor. Typically the inert gas can be dry nitrogen or dry methane, however, dry nitrogen is preferable and shall in the context here cover all types of applicable inert gases.

In cases where pumps have liquid filled motor, the motor is filled with an inert liquid, i.e. a liquid that is not harmful to the internal materials of the motor and of the gear in cases where a gear is located in the same compartment as the pump.

It shall be mentioned that only main components necessary for understanding of the state of the art of subsea motor-compressor included in FIG. 2. and the following FIGS. 3-6.

Other vital components necessary for design of a complete operable subsea compressor or pressure booster not included are: Motor gas cooling system, HV power connectors for transmission of power to the motor, LV cables for signal and control of the magnetic bearings, balance piston and others.

However, while subsea processing equipment has gained acceptance over the resent years for being a realistic option, there is more reluctance against electric and electronic equipment, i.e. a perception of that this type of equipment will have low reliability and robustness. This is particularly valid for static subsea variable speed drives, VSD for electric motors. [VSD is also called variable frequency drive (VFD) and frequency converters.] It is therefore a common view in the professional environment that the risk for lost production by application of subsea VSDs is considered to be high and they should if possible be avoided. A SVSD (subsea VSD) will also be large in dimensions and weight and therefore not easy to install and retrieve. The cost will also be high.

A subsea VSD located near the turbomachine will allow a low frequency high power electric power transmission through the subsea step out cable, which allows a far longer step out length. However, the cost of a feasible subsea VSD for a motor of 10 MW can indicatively be 100 MNOK, the weight about 100 tons, the height about 11 m and the diameter about 3 m. But a worse problem is the risk of limited reliability of a subsea VSD.

Even though the subsea VSD contains top quality components, each of very high quality and reliability, the large number of components and the complexity of the structure result in a total subsea VSD reliability that may be a significant problem.

A demand for further improvement still exists, for pressure boosters in general and subsea pressure boosters in particular, and the objective of the present invention is to meet said demand.

SUMMARY OF THE INVENTION

The demand is met with a subsea turbomachine for boosting the pressure of petroleum fluid flow from subsea petroleum productions wells or systems, comprising an electric motor and a compressor or pump driven by the electric motor, a fluid inlet and a fluid outlet, distinctive that the turbomachine comprises

- a pressure housing common for the electric motor or stator, and compressor, pump or rotor;
- a magnetic gear inside the common pressure housing for operative connection between the motor or stator and compressor, pump or rotor; and
- a partition inside the common pressure housing, arranged so as to separate a motor or stator compartment from a compressor, pump or rotor compartment.

The partition preferably comprises magnetic pole pieces or electromagnets or both, for modulating the magnetic field coupling and gear ratio of the magnetic gear. The gear ratio can be controlled by energizing or not energizing electromagnets in the partition. In general, the low speed side is the motor or stator side, typically at speed up to about 4000 revolutions per minute-rpm, whilst the high speed side is the compressor, pump or rotor side, typically at speed up to about 12000 rpm, at an effect up to about 15MW. However the speeds and effect can, at least in the future, be varied beyond the limits indicated here.

The magnetic gear is preferably a magnetic step-up gear allowing subsea step out lengths far above 40 km since the Ferranti effect can be handled. A magnetic step up gear is estimated to result in reliability much higher than that of a SVSD. Indicatively cost of such a gear will be in the range of 10-15% of that of a SVSD, diameter in the range of 1.5 m and length 1.5 m and weight in the range of 5-10 tonnes. Compared to use of SVSD it is very favourably to arrange a magnetic step-up gear between the motor and the compressor to increase the speed from the low speed of the motor necessary for stable electric transmission to speed that is required for the compressor. Typically the step-up ratio of the gear can be in the range of 2-3, but the invention covers all ratios from 1, i.e. a magnetic 1:1 coupling, up to what can be necessary from case to case. Compared to prior art solutions, the reliability can be 10 times better, each of size and weight and the cost can be 1/10. Many embodiments of the pressure booster of the invention is contactless, having magnetic gear and magnetic bearings, providing extremely low loss combined with extremely high reliability, making said embodiments particularly favourable both subsea and on dry locations.

The magnetic gear can be of any type, e.g. parallel, planetary and cycloid type. Normally the gear is a permanent magnet gear, but gears with electromagnets either on the motor side (i.e. the low speed side) or the compressor side or both sides can also be adapted for subsea pressure boosters.

A favourable design of the magnetic gear is a cycloid permanent magnet gear operatively connecting the motor and turbomachine, more preferably an inner cycloid permanent magnet gear of which the inner ring of the gear is connected to the turbomachine. This allows a very high torque transfer because the permanent magnets of the inner ring are influenced by the permanent magnets of the outer ring for a larger number of magnets, increasing the magnetic coupling and thereby the torque transfer capability. A further advantage is a compact construction compared to conventional spur gear design since one ring is inside the other, and also the simple design which improves reliability and requires no bearings.

A planetary gear will also have these favourable features and more perfect alignment of motor and compressor shaft. Planetary gear embodiments can be very favourable since the torque transfer can be very high due to a large number of pole interactions and the stability can be very good due to symmetrical design with the shafts of the motor and turbomachine coaxially arranged. Also, planetary gears can be arranged so as to allow gear shift.

As mentioned above the invention shall not be limited with respect to type of magnetic gear and it can either be of the permanent magnet or the electromagnet type. The most suitable type of gear will be selected from case to case base among other things on the state of the art of the various types A magnetic gear can be arranged like a gear box where the step-up ratio can be changed in steps. This can be done at standstill of the pressure booster by ROV or by an electric motor mounted in the gear box.

A more conventional way to change step-up ratio is to retrieve the pressure poster and exchange the gear with another gear with the desired new step-up ratio. This can be done I connection with re-bundling of the compressor or pump.

Magnetic gears with electromagnets either on the low speed motor side or the high speed turbomachine side, makes it possible to continuously vary the speed of the turbomachine by increasing or reducing the rotational speed of the magnetic field of the electromagnets, by energizing or not energizing electromagnets.

The motor, gear and compressor will be arranged in common pressure housing, however one or more partition with shaft seals is located between the main components dividing the common pressure housing into compartments where the main components are installed. A favourable design to protect motor and gear with their magnetic bearings is to have a partition between a compartment containing motor and gear on one side of at least one shaft seal and the compressor on the other side.

The pressure housing can be one piece, since the number of possible fluid leakage paths thereby is minimised. Alternatively, the pressure housing can have flanges between the compartments with main components if this is found favourable for replacing components at a later stage, for example in order to increase a compressor speed at the tail end production from a reservoir by increasing the gear ratio.

The pressure booster preferably comprises shafts with magnetic bearings, one shaft for the motor with the low speed part of the gear and one shaft for the turbomachine with the high speed part of the magnetic gear. If cycloid gear is used, an outer ring of the magnetic gear is connected to the motor shaft and an inner ring of the magnetic gear is connected to the turbomachine shaft. Each shaft is suspended in two radial magnetic bearings, one in or near either end, and one thrust magnetic bearing and a 5-axis control system is operatively connected to the bearings of each shaft The magnetic bearings require a comprehensive control system in order to be operative, requiring a control unit on the seabed, since the shafts are actively controlled by the electromagnets of the bearings in order to rotate without physical contact. A 5-axis control system is favourable because it is a proven design and verified to have sufficient reliability for the purpose.

Even though two radial and one axial bearing is sufficient for one shaft, the number of bearings shall not be a limitation to the invention.

Alternative bearings, such as mechanical bearings are possible but will result in need for lube oil susceptible to contamination form the boosted media and requires a rather complicated lube oil system.

Compared to state of the art high speed subsea pressure boosters, which includes a subsea VSD, the booster type of the invention is estimated to have a much higher reliability, presumably in the order of a decade better. And so are dimensions, weight and cost. There exist therefore strong cost and technical incentives for the invention.

By separating the motor and the gear with their bearings from the turbomachine by a partition or diaphragm with a shaft seal, i.e. such that the motor with gear and the turbomachine are located in separate compartments, it will be possible to protect the motor and gear from harmful amounts of contaminants from the boosted media by supply of small supply of an inert fluid with respect to the motor and gear materials such that this fluid at all time constitutes the major composition of the motor-gear volume, and contaminants that should enter this volume will be diluted to non-damaging concentrations. The supplied inert fluid will be lost by flowing through the seal.

As example can be indicated that the loss of inert liquid for a pump is in the order of 1 liter per day per seal.

For a compressor the atmosphere of the compartment for gear and motor in theory should be kept protected from contaminant by having a flow velocity of an inert gas through a seal higher than the diffusion velocity of the contaminants. If the total atmosphere volume of the motor and gear included gas cooler and piping is 2 $m^2$, it is assumed that a supply of inert gas, e.g. dry nitrogen or dry methane, at a rate that results in some few volume exchanges per year is enough to protect the materials from being damaged If for example a pressure vessel or tank of 10 $m^3$ is located on or at the compressor and has starting pressure of 450 bar and the suction pressure of the compressor is 50 bar, an estimate will result in that the 2 $m^3$ atmosphere of the motor-gar compartment can be exchanged approximately 20 times, i.e. with one exchange of atmosphere per month the tank will last for well below one year before recharging, which can be done from ship by ROV when necessary.

Another design that completely protects the motor and the low speed gear part at the motor or stator side from contaminants is by hermetically separating the low and the high speed part (compressor or rotor side) by a partition or separation wall, sometimes called shroud, similar to what is used for magnetic couplings. To keep the necessary strength and thereby thickness of the shroud reasonable, the pressure difference between the compressor and motor atmosphere should at all time be kept within acceptable limits by some kind of pressure balancing device. The partition, shroud or separation wall is for the most part non-magnetic but should however preferably comprise pole pieces or electromagnets arranged in the partition between the magnets on either side of the partition in order to modulate the gear coupling and gear ratio.

A very preferable embodiment of the invention is a turbomachine distinctive in that it is a pressure booster comprising a stator compartment and a rotor compartment, the rotor compartment comprises a compressor or pump arranged directly on the rotor or coupled to the rotor. The compartments are separated with a diaphragm, partition or shroud, preferably hermetically separated, and pole pieces or electromagnets are arranged in the partition between the magnets on either side of the partition in order to modulate the gear coupling and gear ratio. Said turbomachine is for subsea and topsides use since the solution appears to be completely novel.

FIGURES

DETAILED DESCRIPTION

In the following the invention in several embodiments will be illustrated and explained by figures. Reference is made to Table 2 for understanding of FIG. 3-5. It shall be mentioned that only main components necessary for understanding of the invention are included in FIGS. 3-6.

TABLE 2

| Item # | Explanation |
|---|---|
| 1 | Motor |
| 2 | Compressor or other turbomachine |
| 3 | Pressure housing |
| 4 | Shaft seal |
| 4' | Partition |
| 5 | Compressor (or other turbomachine) inlet |
| 6 | Compressor (or other turbomachine) outlet |
| 7 | Compartment for motor and magnetic gear or low speed part of the magnetic gear |
| 8 | Compartment for compressor and high speed side of gear |
| 9, 9' | Shafts |
| 10 | Shaft coupling either rigid or flexible or common shaft for compressor and motor |
| 11, 11', 11'', 11''' | Radial bearings |
| 12, 12' | Axial bearings |
| 13 | Magnetic gear |
| 14 | Low speed side of magnetic gear |
| 15 | High speed side of magnetic gear |
| 16 | Partition, diaphragm or shroud hermetically separating low and high speed of gear |
| 17 | Pressure vessel or tank for nitrogen |
| 18, 18' | Control valves |
| 19 | Pressure-Volume-Regulator (PVR) |
| 20, 20', 20'' | Tubes |

Figure 1:
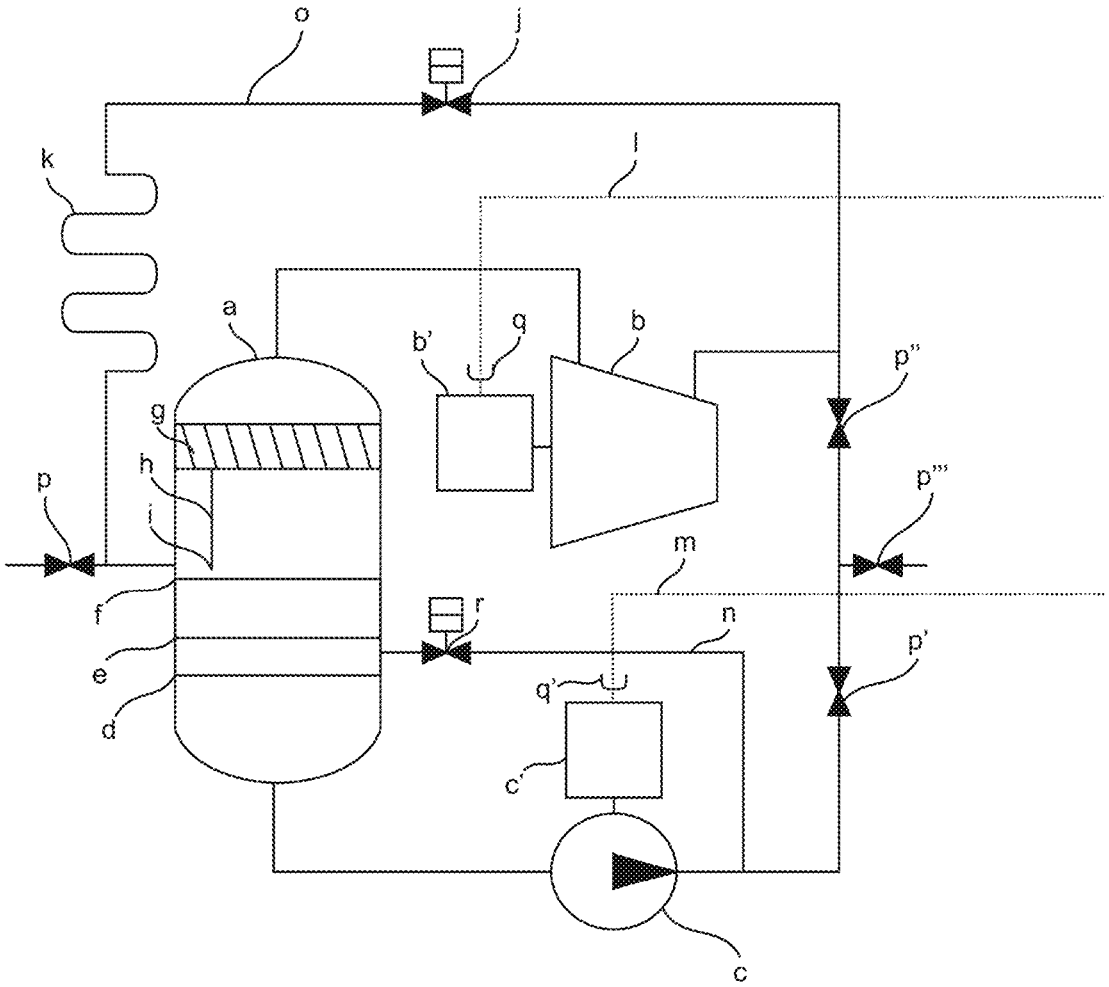
FIGS. 1 and 2 illustrate prior art solutions.
Figure 2:
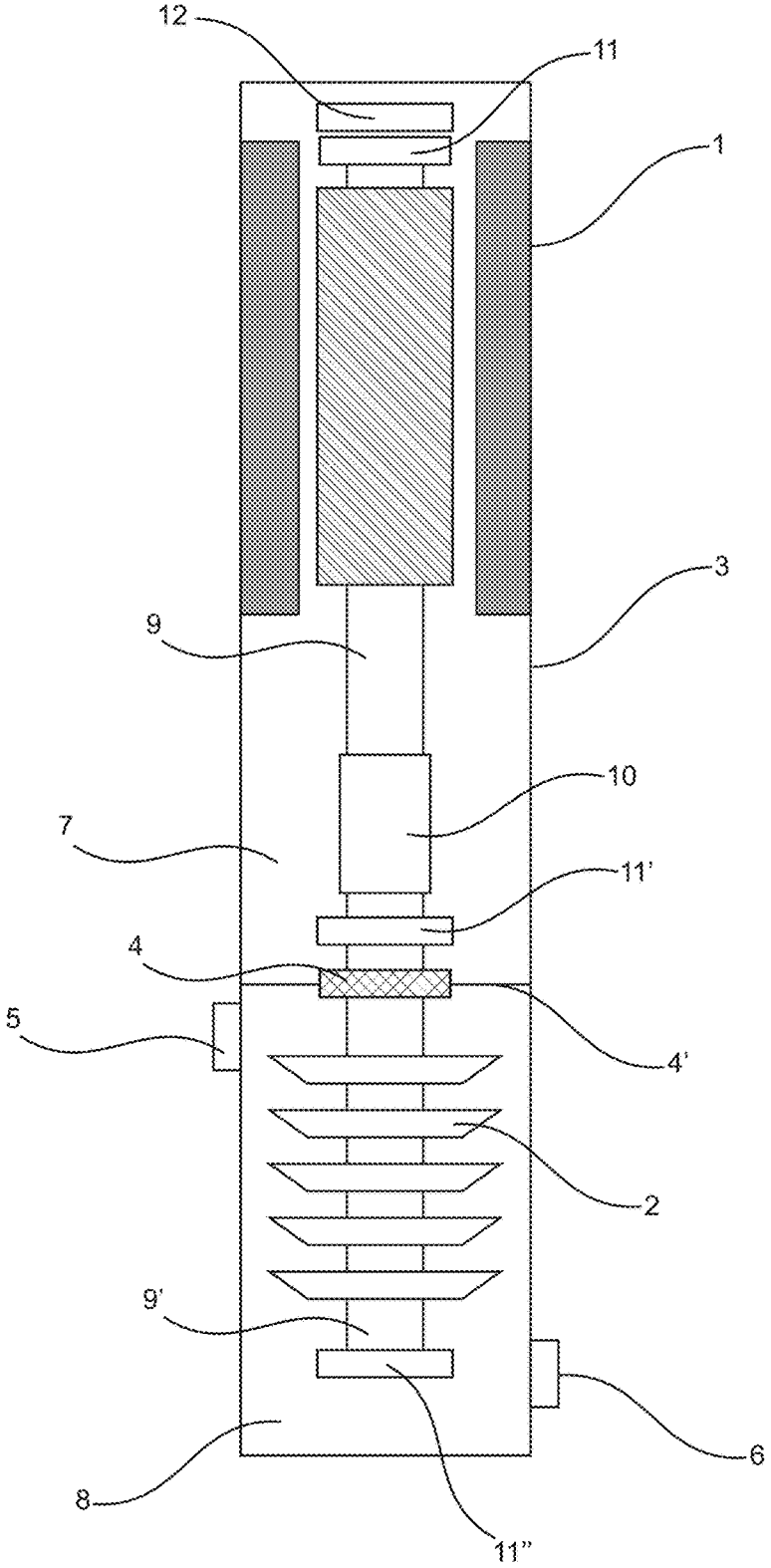
Figure 3:
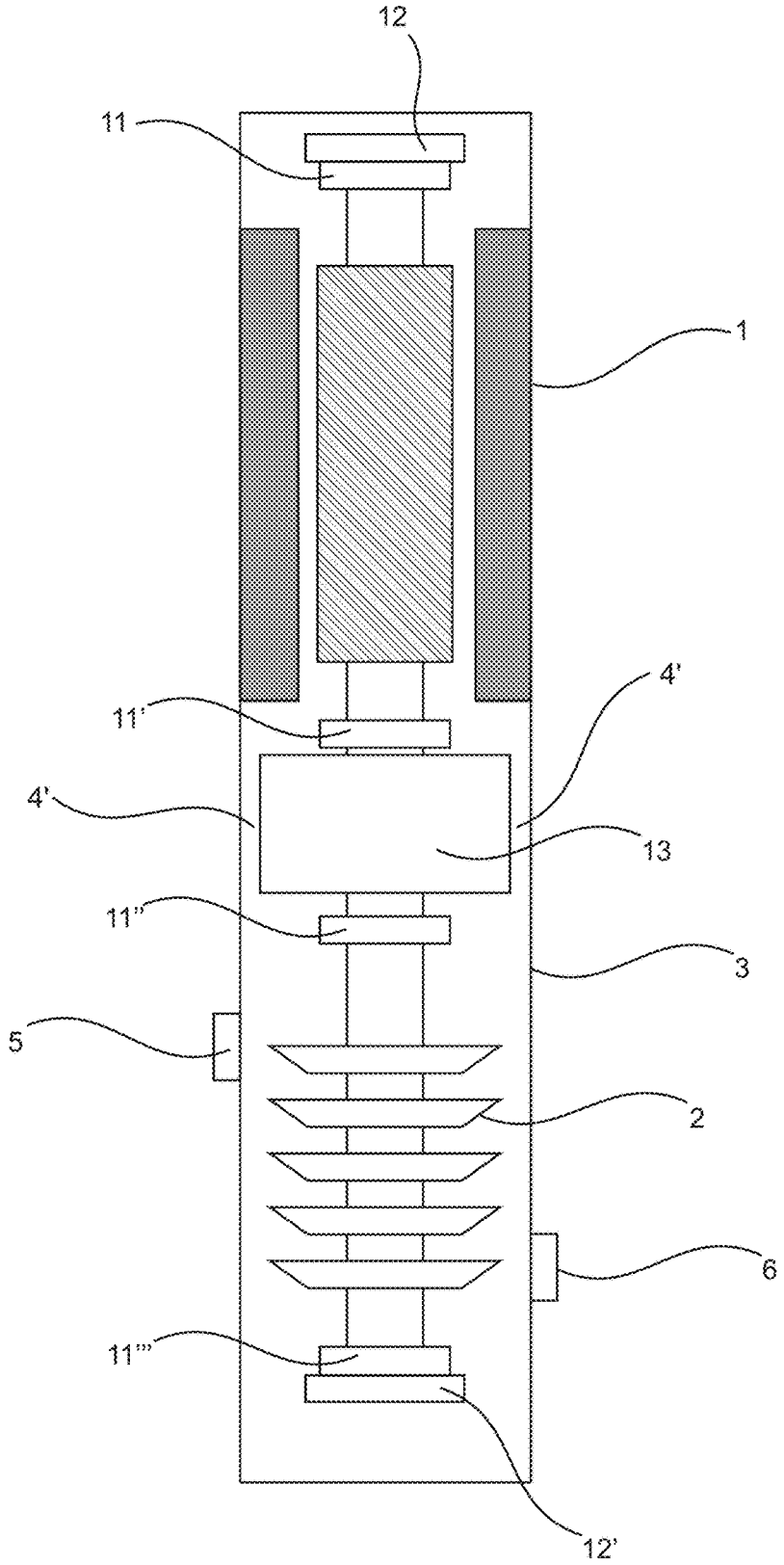
FIGS. 3 to 6 illustrate embodiments and features of the present invention, and FIG. 7 gives examples of magnetic gears.

Reference is made to FIG. 3 illustrating a pressure booster in the form of a compressor with magnetic gear and electric motor, and where the magnetic gear has a step-up ratio that steps up the speed from that of the motor shaft, which is low enough to be supplied with a low enough frequency to have stable cable transmission, to the necessary speed of the compressor. The motor can for instance rotate with a speed of 3000 rpm, i.e. the electric power has a frequency of 50 Hz for a 2-pole motor, and the gear can have a step up ratio of 2.5:1, meaning that the compressor has a speed of 7500 rpm. If the surface located power source has a VSD, the frequency can for instance be varied between 33 and 67 Hz. A partition 4' is arranged between the magnetic gear 13 and the pressure housing and inside the magnetic gear, not shown, between the gear higher speed and lower speed sides.

Figure 4:
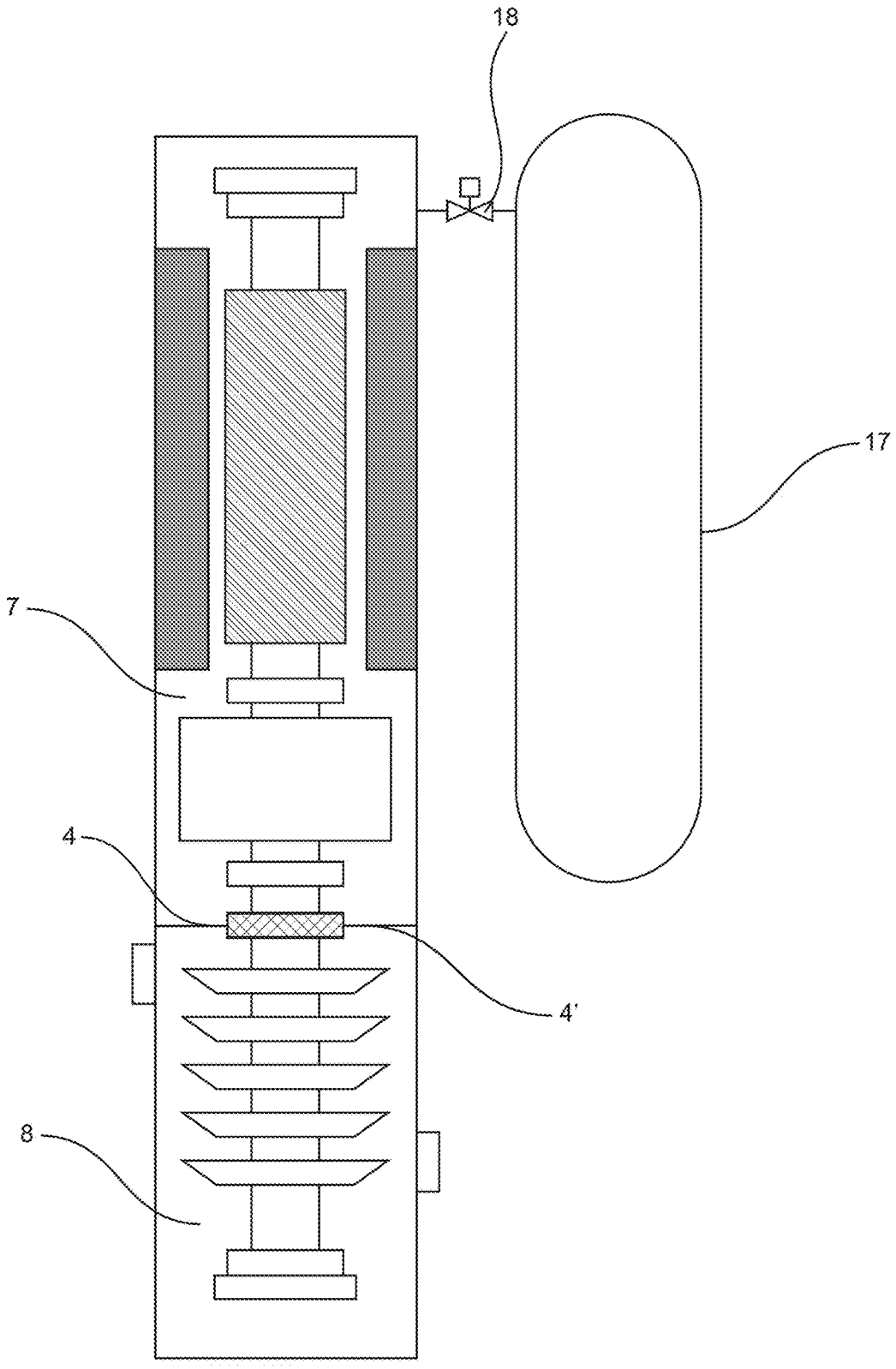

Reference is made to FIG. 4 illustrating that there is a partition 4' with a shaft seal between the compressor 2 in compartment 8 and the motor and magnetic gear in compartment 7. Pressure vessel or tank 17 contains nitrogen reservoir at high pressure, e.g. 400 bar charging pressure, and nitrogen is supplied in a small but sufficient rate to the motor-gear compartment to keep its atmosphere harmless with respect to ingress harmful components of boosted gas which in principle will be kept our of the motor-gear compartment by flow of nitrogen from motor compartment and into the compressor. Some ingress of contaminants from the gas being boosted may sometimes happen, but these components will be diluted to harmless levels by the continuous supply of nitrogen. Alternatively the nitrogen can be supplied by tube in an umbilical.

If the arrangement shown in FIG. 4 with supply of nitrogen from a pressure vessel is used, the flow regulation by valve 18 can be controlled by measurement of the pressure in the vessel 17. The decrease of the pressure is expression for the flow out of the vessel with sufficient accuracy because the temperature of the gas volume in the tank is close to constant, i.e. the seawater temperature, that at deep water is close to constant year around. Alternatively to setting a small flow of nitrogen through valve based on calculations and experience to keep the nitrogen atmosphere in compartment 7 harmless, the valve can be controlled by having sensors in the nitrogen atmosphere that measures the concentration of contaminants in the nitrogen; e.g. total hydrocarbons, selected hydrocarbons (e.g. heavy hydrocarbon molecules) water vapour, $H_2S$, $CO_2$, MEG vapour or other harmful components that indicates the degree of contamination of the atmosphere. The valve 18 can than based on these measurements regulate the supply of nitrogen to keep the degree of contamination below a harmful level. This level can be established by experience and knowledge about the tolerance of the various contaminants of the materials in compartment 7. The control of valve 18 can either be continuous or intermittent.

Figure 5:
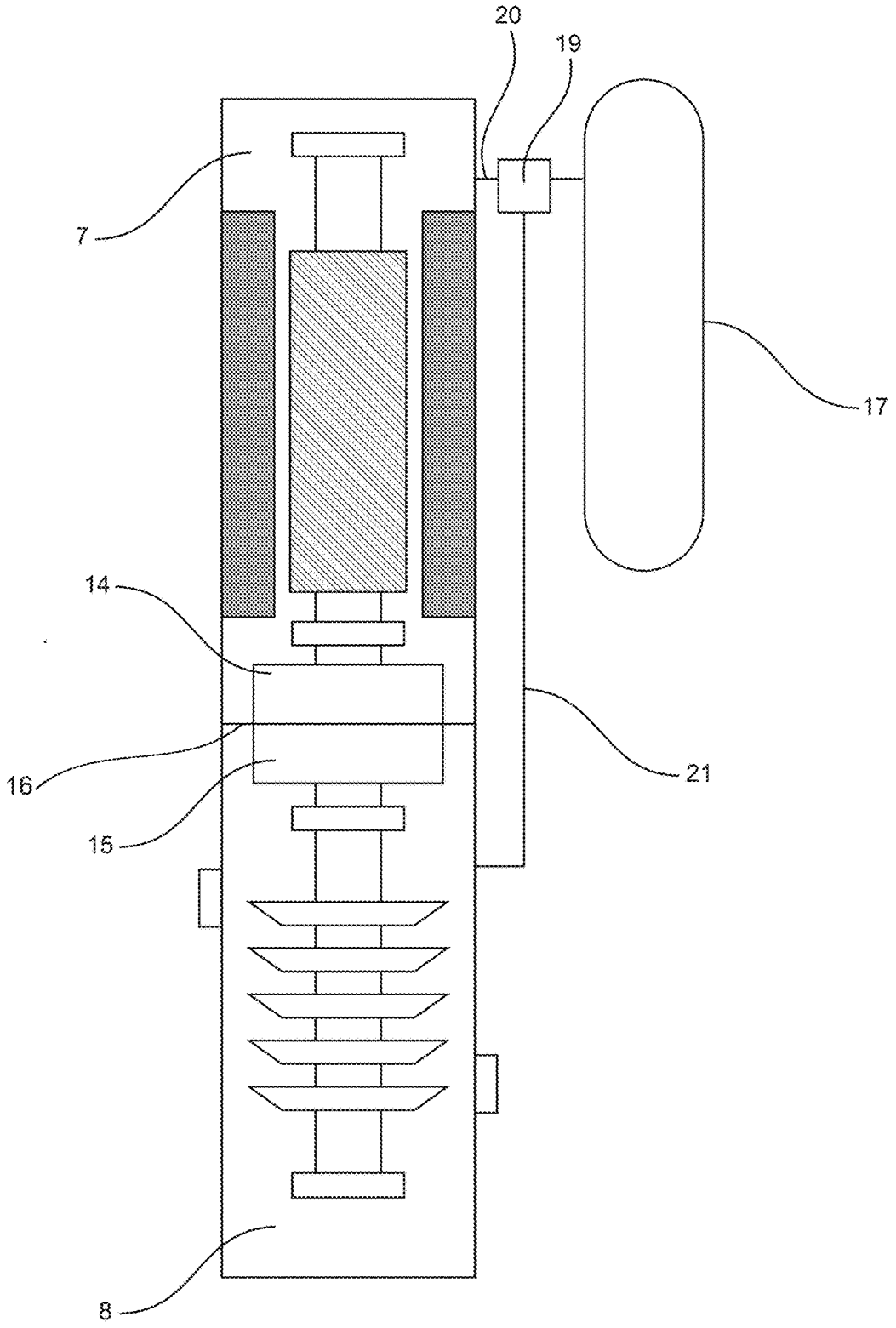

In FIG. 5 is given an illustration of a compressor where the high speed motor side of the magnetic gear is hermetically separated from the low speed motor side by a partition or diaphragm also called shroud. In this way the motor with its part of the gear and magnetic bearings is hermetically separated (compartment 7) from the compressor with the high speed part of the gear and magnetic bearings (compartment 8). Some kind of pressure balancing of the pressure of the motor-gear atmosphere of compartment 7 compared to the suction pressure of the compressor in compartment 8 will be necessary to keep the requirements of the strength of the shroud reasonable. In FIG. 5 the pressure balancing is arranged by supply of nitrogen from tank 17 (or alternatively from tube in umbilical) through pressure transmitting tube 20 and by a Pressure-Volume-Regulator, PVR, which is a well known and verified device. A pressure transmitting tube is connected to the compressor compartment, and the PVR will continuously compare and control the pressure of the motor-gear atmosphere to be close to the compressor suction pressure. Pressure balancing can also be arranged with an arrangement of pressure regulating valves 18 and 18' and pressure sensor or sensors that detects the pressure difference between the motor-gear compartment and the compressor suction pressure.

Figure 6:
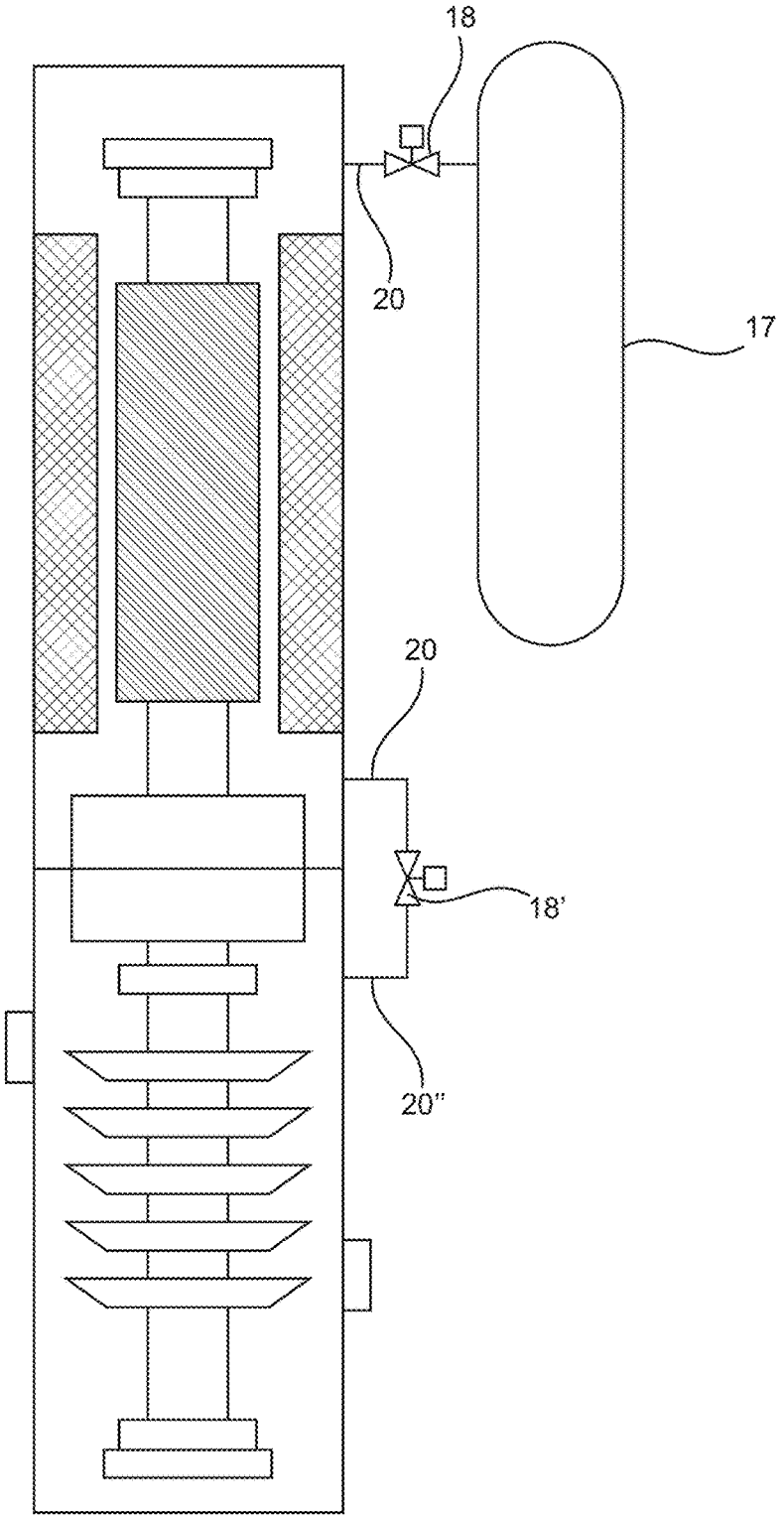

In FIG. 6 is an illustrated pressure balancing device by use of two control valves being controlled by measurement of pressure differential between compartments 7 and 8. Nitrogen is supplied by control valve 18 while overpressure in compartment 7 compared to compressor suction pressure is released by control valve 18'

Figure 7:
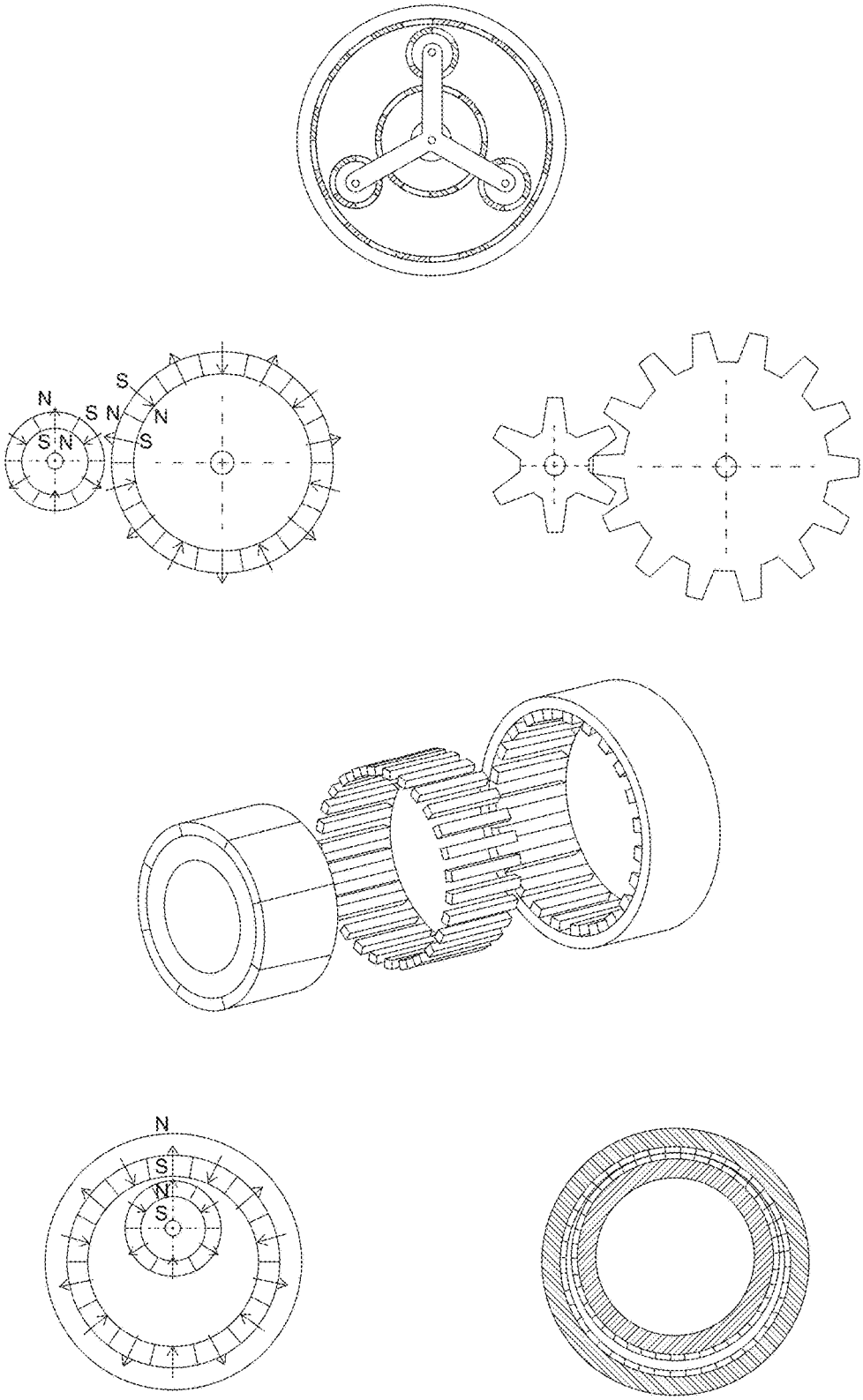

In FIG. 7 is illustrated following types of magnetic gears: Spur (parallel, radial), planet and cycloid gear.

Figure 8:
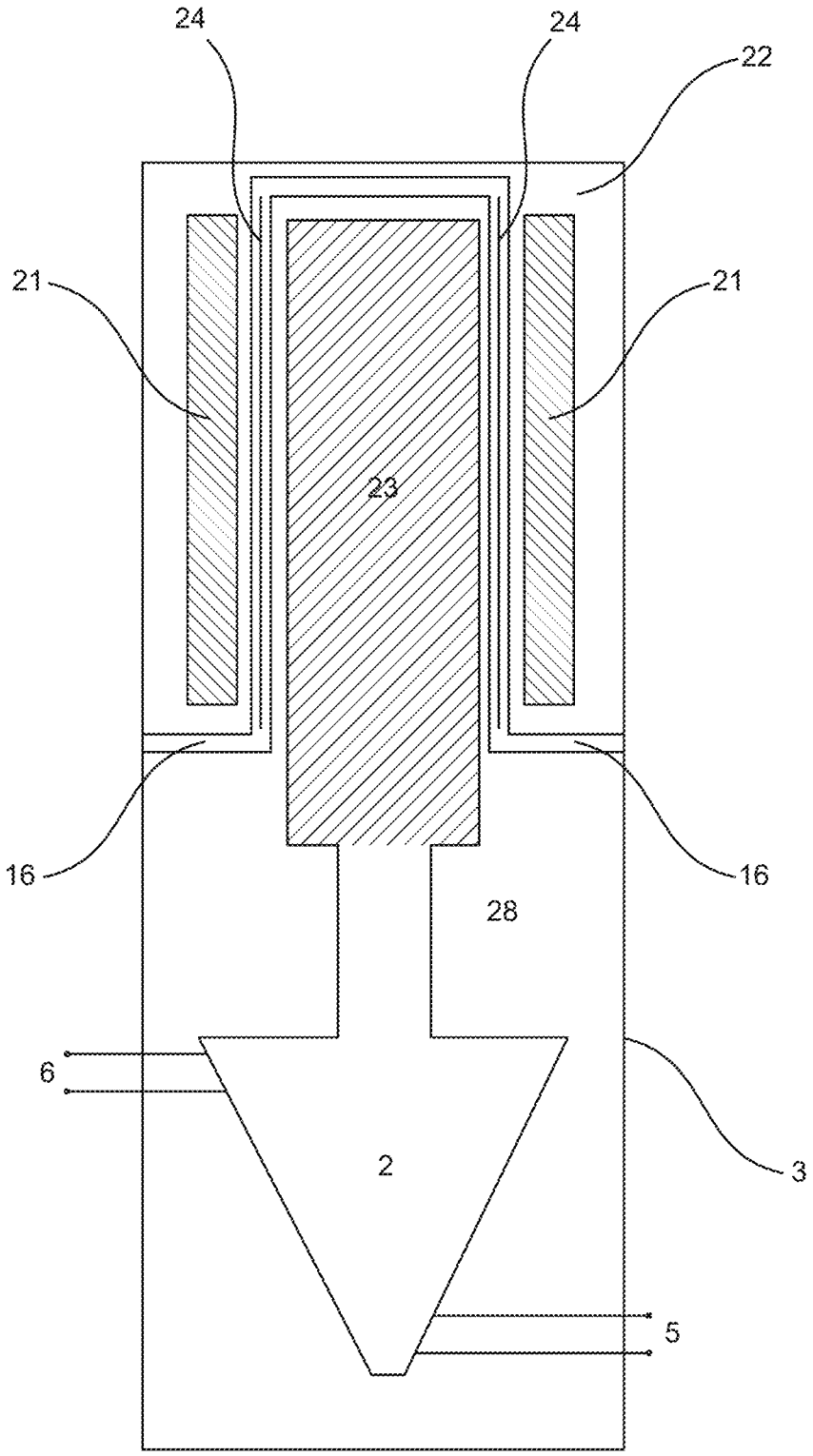
FIG. 8 illustrates a preferable embodiment of the invention.

FIG. 8 illustrates a preferable embodiment of the invention wherein a stator 21 is arranged in a stator compartment 22, separated by a partition 16 from a rotor compartment 28, the rotor compartment comprises a compressor 2 or pump arranged directly on the rotor shaft or coupled to the rotor 23. Preferably, pump or compressor impellers, or both, are arranged directly on the rotor shaft. Preferably the partition 16 seals the stator compartment hermetically from the rotor compartment. The partition preferably includes pole pieces 24, electromagnets or both, for enhanced magnetic coupling, arranged between the gear sides, for a set or controllable gear ratio. The gear ratio can be controlled by controlling optional electromagnets in the partition, the rotor position can be inferred from the impedance of the stator, by using an algorithm or a look up table. The rotor shaft may preferably comprise bearings on either end, and also on the shaft between rotor and impellers if required.

Figure 9:
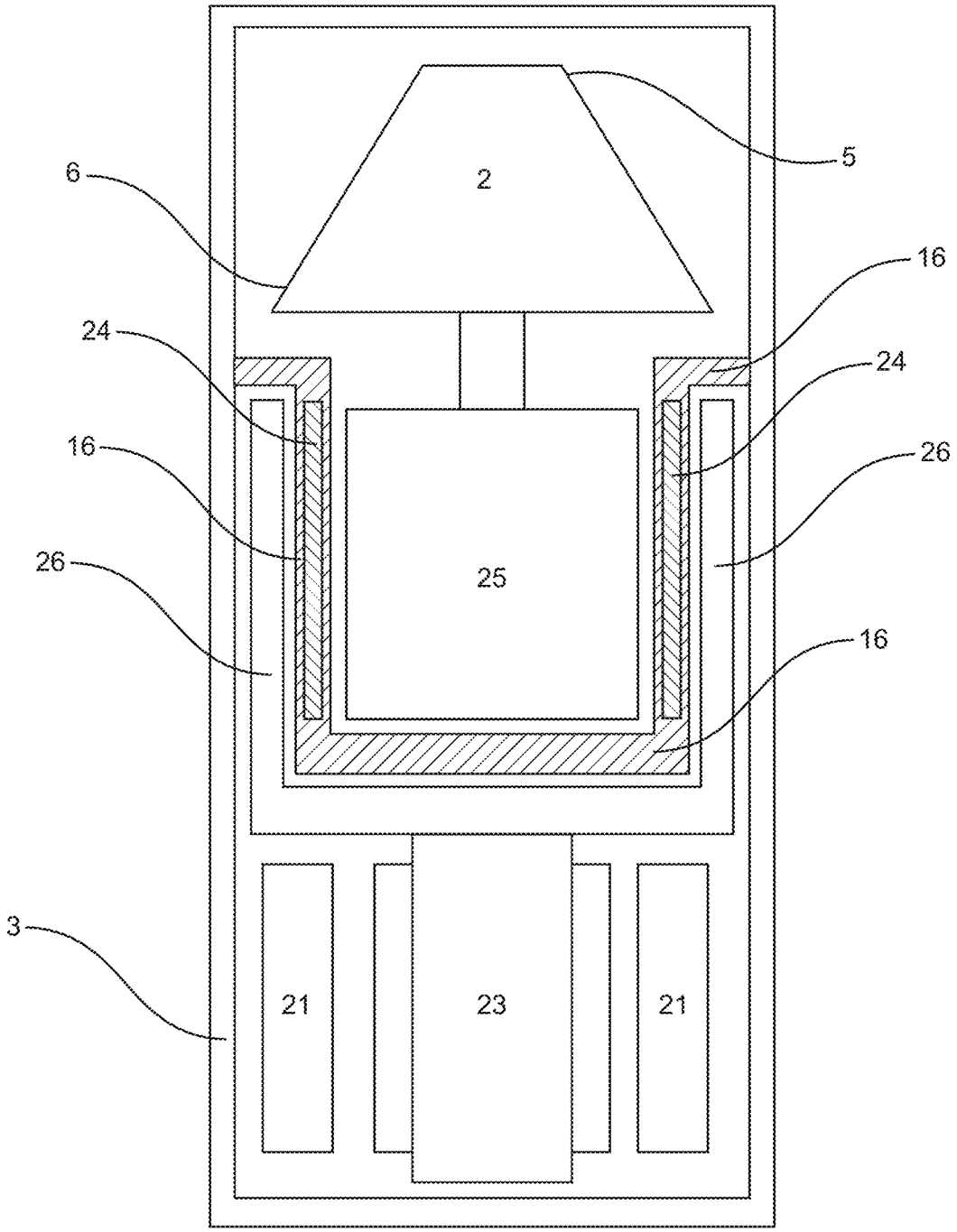
FIG. 9 illustrates in some more detail the magnetic gear of a subsea turbomachine of the invention.

FIG. 9 illustrates a preferable subsea turbomachine or a general purpose turbomachine or pressure booster according to the invention, wherein the magnetic gear is a radial magnetic gear with the partition 16 arranged between the inner part 25 and outer parts 26. Increasing the length of the gear allows better magnetic coupling and transfer of higher effect, which is preferable, but may require extra bearings on the gear end of the shaft. The partition comprises magnetic pole pieces 25 or electromagnets or both in the partition between the lower speed and higher speed sides of the gear. The number of pole pieces and/or electromagnets are related to the gear ratio, preferably the number of rotor elements and the number of pole pieces or electromagnets are multiples or fractions of the number of stator elements, the multiple or fraction ratios relate to the gear ratio. The gear ratio can be controlled by energizing or not energizing electromagnets in the partition, said electromagnets are preferably connected electrically to the stator power source or side, avoiding any slip rings or other rotatable electric connections. This figure illustrates in more detail the magnetic gear, the partition 16 and pole pieces 24 or similar, and the common pressure housing 3, whilst the motor with stators 21 and rotor 23, and the compressor 2 are illustrated out of scale and not to detail, for clarity. Bearings and some other features are for clarity not illustrated or only indicated in order to show more clearly how the magnetic gear coupling can be configured and arranged. With a radial gear of the type illustrated, which side is the inner or outer side or faster or slower side can be subject to a choice of design, however, in many cases the faster side should be the inner side since this will in most cases result in lower stress levels.

Some of the advantages of the invention are as follows:

Non-contact elements—no friction between the elements.

High torque transfer due to multiple pole interaction.

Utilization of peak torque.

Input and output shafts can be isolated.

Increased temperature range, no elastomeric seals.

Inherent overload protection.

Increased tolerance of misalignment.

Several options for arranging shift of gear ratio, several mechanical and several electronic options.

The liquid lubrication system and supply can be eliminated.

The pressure boosters or turbomachines of the invention may include any features as described or illustrated in this document, in any operative combination, each such combination is an embodiment of the present invention. The invention also provides use of the turbomachine and pressure booster of the invention, for pressure boosting fluids subsea and topsides, particularly gas and oil subsea.

The invention claimed is:

1. A subsea turbomachine for boosting a pressure of a petroleum fluid flow from subsea petroleum production wells or systems, the subsea turbomachine comprising:

an electric motor comprising a rotor and a stator, the rotor and the stator being disposed in a motor compartment;

a fluid inlet;

a fluid outlet;

a pressure housing common for the electric motor and at least one of a compressor and a pump;

a magnetic gear inside the common pressure housing for operative connection between the electric motor and the at least one of the compressor and the pump;

an electric motor shaft and a turbomachine shaft;

wherein an outer ring of the magnetic gear is connected to the electric motor shaft and an inner ring of the magnetic gear is connected to the turbomachine shaft, or opposite;

wherein the electric motor shaft and the turbomachine shaft are suspended in bearings;

a partition inside the common pressure housing, arranged so as to separate the motor compartment hermetically from a pump or compressor compartment such that the subsea turbomachine has no external liquid lubrication system or supply; and a pressure balancing device independent from the fluid inlet and the fluid outlet comprising an arrangement between an inlet side of the pump or compressor compartment and the motor compartment, the pressure balancing device further comprising two control valves.

2. The subsea turbomachine according to claim 1, wherein a gearing ratio of the magnetic gear is 1:1.

3. The subsea turbomachine according to claim 1, comprising at least one of a planetary magnet gear and an inner cycloid magnet gear wherein an inner ring of the at least one of the planetary magnet gear and the inner cycloid magnet gear is connected to the compressor or pump.

4. The subsea turbomachine according to claim 1, wherein the magnetic gear comprises permanent magnets.

5. The subsea turbomachine according to claim 1, wherein the magnetic gear comprises electromagnets on at least one of a low speed side, a high speed side, or both sides of the magnetic gear.

6. The subsea turbomachine according to claim 5, wherein a rotational speed of a magnetic field on at least one of the low speed, the high speed, or both sides of the magnetic gear can be controlled to vary speed of the pump or compressor up and down compared to the speed of the electric motor shaft.

7. The subsea turbomachine according to claim 1, wherein the magnetic gear is arranged as a gearbox that makes the magnetic gear possible to change a step-up ratio standstill by use of an ROV or by a dedicated electric motor disposed at the gearbox.

8. The subsea turbomachine according to claim 1, comprising at least one penetrator connected for receiving electric power and signals to operate the turbomachine.

9. The subsea turbomachine according to claim 1, wherein the magnetic gear is a radial magnetic gear with the partition arranged between the inner and outer parts.

10. The subsea turbomachine according to claim 1, wherein the magnetic gear is a cycloid magnetic gear or any radial magnetic gear with the partition arranged between the inner and outer parts.

* * * * *